US005107612A

United States Patent [19]

Bechtel

[11] Patent Number: 5,107,612

[45] Date of Patent: Apr. 28, 1992

[54] MOUNT FOR ATTACHING A SIGHTING AID TO A PISTOL

[76] Inventor: Daniel L. Bechtel, 4701 Inwood Rd., Ft. Worth, Tex. 76109

[21] Appl. No.: 532,860

[22] Filed: Jun. 4, 1990

[51] Int. Cl.[5] ..... F41G 1/38

[52] U.S. Cl. ..... 42/103; 33/248

[58] Field of Search ..... 33/248, 250; 42/101, 42/103

[56] References Cited

U.S. PATENT DOCUMENTS

| | | | |
|---|---|---|---|
| 1,215,171 | 2/1917 | Lewis | 42/103 |
| 2,336,718 | 12/1943 | Davis | 42/103 |
| 4,418,487 | 12/1983 | Strahan | 42/101 |
| 4,533,980 | 8/1985 | Hayes | 42/103 |
| 4,777,754 | 10/1988 | Reynolds, Jr. | 42/103 |
| 4,856,218 | 8/1989 | Reynolds, Jr. | 42/103 |
| 4,878,307 | 11/1989 | Singletary | 42/101 |
| 4,890,407 | 1/1990 | Nichols | 42/103 |
| 4,894,941 | 1/1990 | Karow, Jr. | 42/101 |
| 4,941,277 | 7/1990 | Lawlor | 42/101 |

*Primary Examiner*—Richard W. Wendtland
*Attorney, Agent, or Firm*—Charles W. McHugh

[57] ABSTRACT

A rigid mounting apparatus for attaching an auxiliary sighting aid to a pistol. In one embodiment, two major shapes are utilized, one of which has a transverse cross-section that is generally U-shaped; the second shape forms an L-shaped bracket that fits below the barrel of a pistol and lies ahead of the trigger guard. In another embodiment, three elements are designed to fit in such a way that, in combination, they establish a U-shaped body for mounting a sighting aid above the barrel. Two side plates of this embodiment are configured so that they can be extruded from a common die; one of them is rotated so that the two plates form mirror images of each other when they are attached to a pistol. A bracket cooperates with some structural element on the pistol (such as the slide latch pin) to securely hold the mounting apparatus in place when the pistol is fired, so that recoil forces from firing will not cause the mounting apparatus to shift with respect to the pistol. Threaded fasteners hold the various pieces rigidly together. Adjustment screws may be used to take up any slack between the main structural parts of the mounting apparatus and the pistol's frame.

20 Claims, 3 Drawing Sheets

MOUNT FOR ATTACHING A SIGHTING AID TO A PISTOL

BACKGROUND OF THE INVENTION

This invention relates generally to auxiliary sighting aids for hand-held firearms, namely, pistols; more specifically, it relates to an apparatus that is useful in attaching an auxiliary sighting aid (such as a flashlight, laser, night-vision device or telescope) to the frame of a pistol without removing or interfering with the original or factory-installed "iron" sights.

It is well known to add auxiliary sighting aids to pistols and other hand-held firearms, for the purpose of improving the ability of a shooter to hit the target that he or she is aiming at. Such auxiliary sighting aids include telescopes and night-vision devices that gather whatever ambient light is available in the field of view and sometimes enhance the image that is presented to a user. Such aids also include lasers or flashlights that project light from some source adjacent the firearm in a direction parallel to the firearm's barrel. Whenever possible, these auxiliary sighting aids are added to firearms without removing or otherwise obstructing the line of sight that is established by the so-called iron sights that are routinely installed at a factory. Therefore, when evaluating any new mounting scheme for auxiliary sights, it is reasonable to inquire whether the original factory sights are left intact and capable of being used as an alternative to any new sighting aid. A prudent designer will anticipate this inquiry and attempt to find some structural part of a firearm to serve as a structural base to which an auxiliary mount can be affixed without disabling the original sights.

Certain semi-automatic pistols are characterized by the presence of a relatively large slide that moves on the exterior part of the pistol. One very common example of such pistols is the Colt Model 1911 .45 caliber semi-automatic pistol. The fact that the external slide of such a pistol moves longitudinally every time the pistol is fired means that a stable, non-moving base is not present on the upper part of the pistol, as is common with revolvers and some other semi-automatic pistols. The absence of a static, upper base to which a scope mount could be attached was overcome at least as early as 1982 when Travis R. Strahan, a gunsmith in Ringgold, Ga. disclosed a technique for adding a scope-type mount to a semi-automatic pistol having a movable slide. The Strahan teachings are now disclosed in U.S. Pat. No. 4,418,487 entitled "Mounting Bracket for Gun Sight." A notable feature of the Strahan construction is its use of a "common fastener" that is used to hold the sight mount on the pistol and also serve as a functional part of the pistol. In the Strahan disclosure, the original slide stop pin is removed and replaced with a slightly longer pin. The extra length of the new pin serves to hold the mount on the pistol, while the middle part of the pin cooperates with other parts to permit normal operation of the pistol.

The identical principle of using a modified slide stop pin in a dual capacity has been disclosed in U.S. Pat. No. 4,777,754 to Reynolds, Jr. entitled "Light Beam Assisted Aiming of Firearms." The most significant difference between the earlier Strahan design and the later Reynolds disclosure is that Strahan's auxiliary sighting aid is located above the pistol's barrel while Reynolds' sighting aid is located below the pistol's barrel; otherwise, the concepts are essentially the same. Of course, Reynolds does introduce the concept of meticulously shaping the contour of a battery housing (below the barrel) to the contour of a firearm; but it remains to be seen whether this concept will find acceptance among those in the firearms industry or whether it will be ignored as being too expensive and of questionable merit.

While both Strahan and Reynolds teach techniques for mounting auxiliary sighting aids on a pistol, they do so in a manner that involves either a great deal of expense in labor or engineering, or that involves a substantial waste of both metal and manufacturing energy. That is, mounts in accordance with the Strahan design were originally manufactured by starting with a solid block of metal and using milling machines and the like to cut away the interior of the block, leaving only an exterior framework having the configuration shown in FIG. 2 of the Strahan patent. As most persons would likely agree, making a generally hollow frame out of a massive block of steel or aluminum is not only labor intensive, but it is also wasteful of both energy and material. As a result, sight mounts of the Strahan design were relatively expensive to produce, even though they accomplished the purpose for which they were designed.

Mounting devices in accordance with the Reynolds design could be prepared either by a substantial quantity of machining (as with Strahan) or with investment castings, both of which would contribute to a product that is probably more expensive to build than might be desired. It is an object of this invention, therefore, to provide a mounting apparatus having some of the beneficial characteristics of Strahan and Reynolds but eliminating much of the wastefulness and/or expense of producing such a mounting apparatus. In a sense, then, the present invention may be thought of as an improvement over both the Strahan and Reynolds designs, and a contribution to the field of manufacturing engineering as it relates to scope mounts and the like.

Accordingly, it is an object of this invention to provide a mounting apparatus for attachment to pistols which reduces the quantity of metal that must be removed or wasted in manufacturing such an apparatus.

One more object is to provide a mounting apparatus that can be manufactured at reduced costs in comparison with earlier designs.

Another object is to provide a mounting apparatus for use on semi-automatic pistols having external slides in which elevation adjustments for the apparatus with respect to the pistol's frame may be easily accomplished.

Still another object is to provide a mounting apparatus that can be manufactured and installed with a lower amount of attention to tolerances, because of the many compensating adjustments that can be accomplished by the person who is mounting an apparatus on a pistol.

These and other objects will be more fully appreciated by a careful reading of this specification and the claims appended thereto, and reference to the several figures of the drawing provided herewith.

BRIEF DESCRIPTION OF THE INVENTION

In brief, the invention is based upon a modular concept of providing special shapes that can be extruded at modest cost, cut to size with a saw, machined (if necessary) with relatively straight-forward milling cutters, drilled and/or tapped as appropriate, and then assembled with bolts to form a rigid mounting apparatus for attaching an auxiliary sighting aid to a pistol. In one embodiment, two major shapes are utilized, one of which has a transverse cross-section that is generally U shaped; the second shape forms a bracket that fits below the barrel of a pistol and lies ahead of the trigger guard. Finished pieces made from these two shapes are mounted on a pistol and secured with threaded fasteners without any permanent alterations to the pistol. In another embodiment, a U-configuration (equivalent to that of the first shaped body) is obtained by rigidly connecting together three elements that are designed to fit in such a way that, in combination, they establish a U-shaped body. Ideally, two side plates of this second embodiment are configured in such a way that they can be extruded from a common die; one of them is rotated so that the two plates form mirror images of each other when they are attached to a pistol. A bracket like that used in the first embodiment and having a shape that approximates the letter L is also used in the second embodiment. The bracket cooperates with some structural element to securely hold the mounting apparatus in place when the pistol is fired, so that recoil forces from firing will not cause the mounting apparatus to shift with respect to the pistol.

Adjustment screws may also be used to take up any slack between the main structural parts of the mounting apparatus and the pistol's frame. Such adjustment screws are preferably brass-headed screws, so that their contact with the pistol's frame is less likely to cause any degradation in the pistol's external appearance. The mounting apparatus may be readily manufactured to hold essentially any auxiliary sighting aid, but a cylindrical shape with a diameter of about ¾ inch to about one inch will hold most of the popular auxiliary sighting aids that are now commercially available. A mounting apparatus made in accordance with this concept may be used to attach a sighting aid either above or below the barrel of a pistol.

DETAILED DESCRIPTION OF PREFERRED EMBODIMENTS OF THE INVENTION

Figure 1:
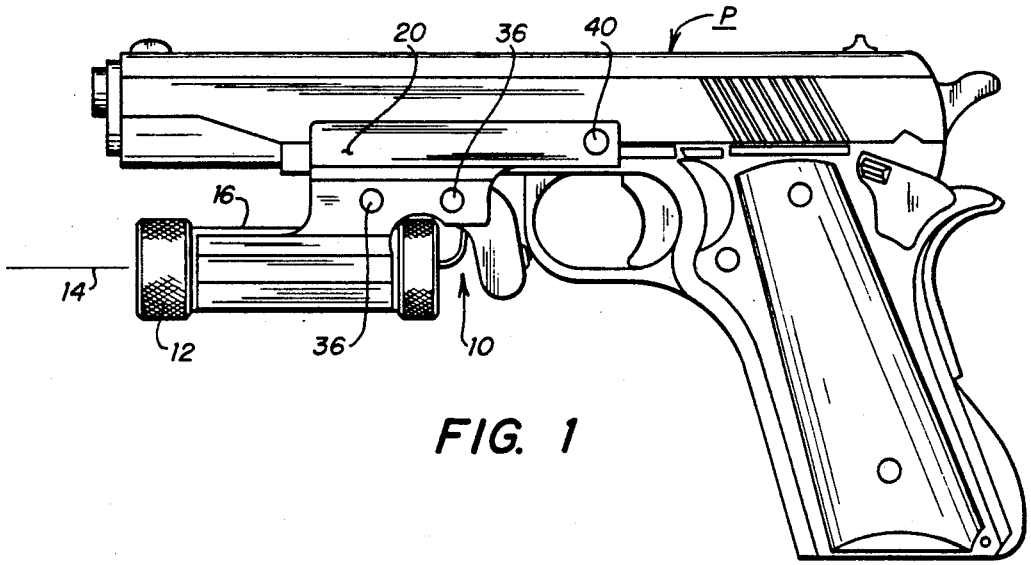
FIG. 1 is a side elevational view of a semi-automatic pistol showing an auxiliary sighting aid in the form of a laser mounted below the pistol's barrel and in front of the trigger guard.

Referring initially to FIG. 1, an exemplary pistol P is shown in elevation, with an apparatus 10 in accordance with one embodiment of the invention mounted underneath the barrel of the pistol. An auxiliary sighting aid 12 in the form of a laser is shown secured in the mounting apparatus 10, such that the longitudinal axis 14 of the laser 12 is generally parallel to the bore of the pistol. The laser 12 is mounted within an elongated body, typically a generally cylindrical housing 16; and the housing is at least partially exposed so that adjustments in the alignment of the laser beam can be accomplished while the housing is still rigidly held by the mounting apparatus 10. A remotely located switch for the laser has been omitted (for clarity), because the laser per se forms no part of this particular invention.

Figure 2:
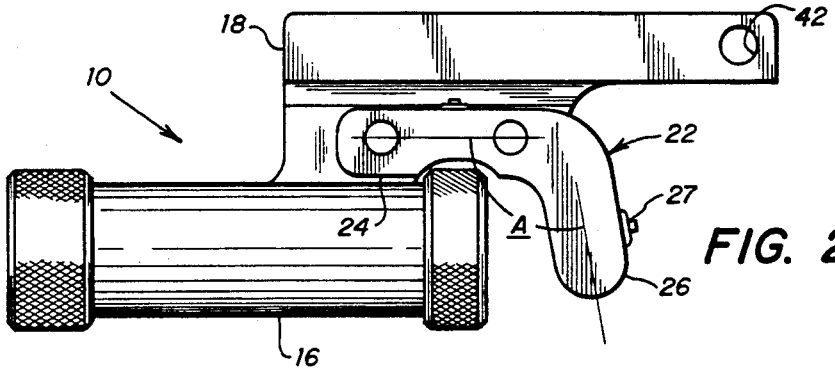
FIG. 2 is a fragmentary elevational view similar to FIG. 1, with the left side plate of the mounting apparatus being removed in order to better show the spatial relationship of other parts.
Figure 3:
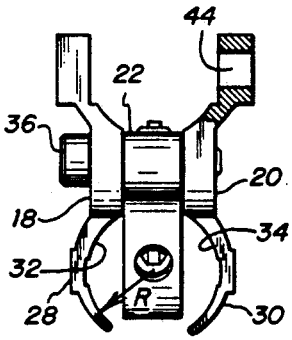
FIG. 3 is a front elevational view of portions of the pistol and mounting arrangement which is shown in FIG. 1.

Referring next to FIG. 2, portions of the pistol and the left side of the mounting apparatus 10 have been removed in order to better reveal the spatial arrangement of certain parts, and to foster a quicker understanding of the invention. Referring additionally to FIG. 3, the right side plate 18 is configured so that it may be attached to the pistol alongside a portion of the right side of the pistol's barrel. The left side plate 20 is similarly configured, so that it may rest along the pistol's left side adjacent a portion of the barrel. When the relatively thin side plates 18, 20 are suitably positioned, they are on opposite sides of the pistol and spaced apart—especially in their lower regions, such that a structural bracket 22 may be inserted between the side plates below the barrel. The bracket 22 has two major portions or legs 24, 26 that lie in planes that intersect one another at a rather pronounced angle A; the preferred angle A is at least 45 degrees and ideally is about 80 degrees. When the angle A is within the range of about 80 to 90 degrees, the bracket will have an appearance similar to that of the letter L. The reason for preferring an angle A of at least 45 degrees will be more readily apparent from a discussion with regard to a subsequent figure of the drawing.

Extending below the bracket 22 are lower portions of the side plates 18, 20. The right lower portion 28 ideally forms a mirror image of the lower portion 30, and indeed, the entire side plate 18 preferably constitutes a mirror image of the other side plate 20, as seen in an end view. Hence, the transverse cross-sectional shape of right side plate 18 will be identical to the transverse cross-sectional shape of left side plate 20. By establishing this relationship between the shapes of the two side plates 18, 20, a single extrusion die can be utilized to extrude aluminum pieces that are capable of being subsequently converted in a machine shop into either a right side plate 18 or a left side plate 20, depending upon the direction in which an initial saw-cut is made and where subsequent milling or drilling is done.

It is also advantageous to configure the interior surfaces of the lower portions 28, 30 in such a way that they may cooperate in supporting therebetween a generally cylindrical member. As indicated by the radius R, the interior portion 32 of lower segment 28 constitutes a segment of a generally cylindrical—though imaginary—body, just as the interior portion 34 constitutes an equivalent cylindrical segment. If the radius R that defines the shape of these two interior portions 32, 34 is ⅜ inch, then a cylindrical member having a diameter of 2×R (or ¾ inch) may be snugly held between the lower portions 28, 30 when the side plates 18, 20 are brought together and held by a fastening means. An example of a suitable fastening means is the bolts or cap screws 36 that are shown in the drawing. One side plate will typically have a smooth bore to accommodate a bolt and the other side plate will typically have an internally threaded bore to mate with the bolt. Typical sizes for such bolts or cap screws are ¼ inch or Number 10.

The selection of ⅜ inch as a value for the radius R is made, of course, after a designer learns what will be the expected outer diameter of an auxiliary sighting aid that is to be held on a pistol. If a flashlight having an outer diameter of one inch is to be held on a pistol, then the radius R would logically be established as ½ inch. The sighting aid that will probably be held by the apparatus 10 will also influence the length of the lower portions 28, 30. If a small flashlight is to be held under a barrel, the lower portions may need to be longer than if a more compact laser is to be held. But since the sighting aid cannot be pushed backward through the fixed trigger guard, it will be necessary that the lower portions 28, 30 project forward from the trigger guard for a distance that will ensure adequate support and hence a reliable alignment between the pistol's bore and the sighting aid.

Referring to the side plates in general, they are additionally configured so that they may cooperate with an anchoring means in order that the side plates 18, 20 will not move longitudinally when the pistol is fired. For semi-automatic pistols of the type exemplified by the Colt Model 1911, a suitable means for anchoring the side plates to the pistol includes a pin 40 that is slightly longer than the pistol's original slide stop pin. Upper portions of the side plates 18, 20 extend rearwardly for a sufficient distance so that a pair of juxtaposed apertures 42, 44 may be brought into alignment with the hole into which the pistol's original slide stop pin is secured. Inserting the new, longer pin 40 through apertures 42, 44 as well as passing it through an integral and fixed part of the pistol will securely anchor the side plates 18, 20 so that they will not move longitudinally (with respect to the pistol) in response to the recoil forces that are generated when the pistol is fired. Of course, the pistol itself may experience some movement in response to the recoil from a fired bullet, especially if the pistol is merely being held in the firer's hand; but the side plates 18, 20 will experience the same recoil as the frame because the pin 40 will cause the plates and the pistol's frame to move as a unit.

The interconnection of pin 40 and side plate apertures 42, 44 will hold the side plates 18, 20 (and any bracket 22 connected thereto) against any unwanted longitudinal movement. But the degree of fixation against other movement will be determined primarily by the extent of any load-bearing contact between the bracket 22 and the pistol's frame. Reynolds teaches that movement between a mount and a pistol may be precluded by contouring a mount very closely to the shape of a pistol's frame, so that intimate contact between the mount and frame can be realized. However, it is believed to be more beneficial, at least from a manufacturing point of view, to avoid such close contouring. Instead of achieving intimate contact between a mounting apparatus and the confronting portions of a pistol's frame, it is preferred that there be established only a very general correspondence between the shape of the pistol's frame (near the trigger guard) and the adjacent surfaces of the bracket 22. Whatever gap is present between the frame and the inner surfaces of bracket 22 can then be bridged by selective adjustment of two spaced-apart screws 25, 27 that extend in directions generally perpendicular to the bracket portions 24, 26. That is, by selectively loosening one adjustment screw 25 in bracket portion 24 and tightening another adjustment screw 27 in bracket portion 26, the bracket 22 (and the attached side plates) may be caused to pivot around pin 40 by a small increment. Such controlled pivoting can be utilized to eliminate any slack between the pistol's frame and the bracket, as well as adjusting an auxiliary sighting aid up or down with respect to the pistol's bore. It is this controlled rotation—for adjustment purposes—that dictates that the bracket angle A should be at least 45 degrees. If the bracket angle were less than 45 degrees, the amount of rotative movement in response to alternately loosening and tightening two inclined screws 25, 27 would be less than satisfying. Ideally, the bracket angle A is about 90 degrees, or as close to 90 degrees as is practicable—in view of the configuration of the pistol's frame in the region ahead of the trigger guard.

Figure 4:
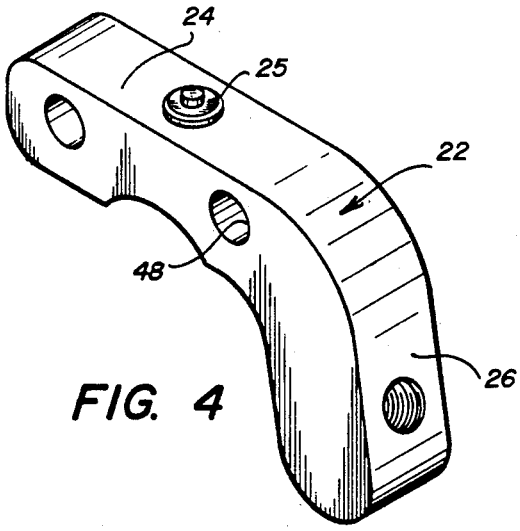
FIG. 4 is a perspective view of a bracket such as the bracket shown in FIGS. 2 and 3, drawn at a different scale to better show at least one of the brass-tipped adjustment screws.

Referring next to FIG. 4, and exemplary bracket 22 is shown in perspective. Placed near the intersection of the two portions 24, 26 is a first bore 48 that extends completely through the bracket 22. When the apparatus is mounted on a pistol, this first bore 48 will be located near the trigger guard of the pistol. The preferred diameter of this bore 48 is just a very few thousandths of an inch larger than the diameter of the cap screws 36 that will be used to hold the plates 18, 20 together. To increase the sturdiness with which the side plates 18, 20 and the bracket 22 are held together, it is preferred that there be two cap screws 36 that extend transversely through the longitudinal plane of the pistol. The length of the cap screws 36 will be chosen to pass from one side plate through the thickness of the bracket 22 and still have enough engaged threads on the other side of the mount to convert a multi-part assemblage into a rigid unit.

Figure 5:
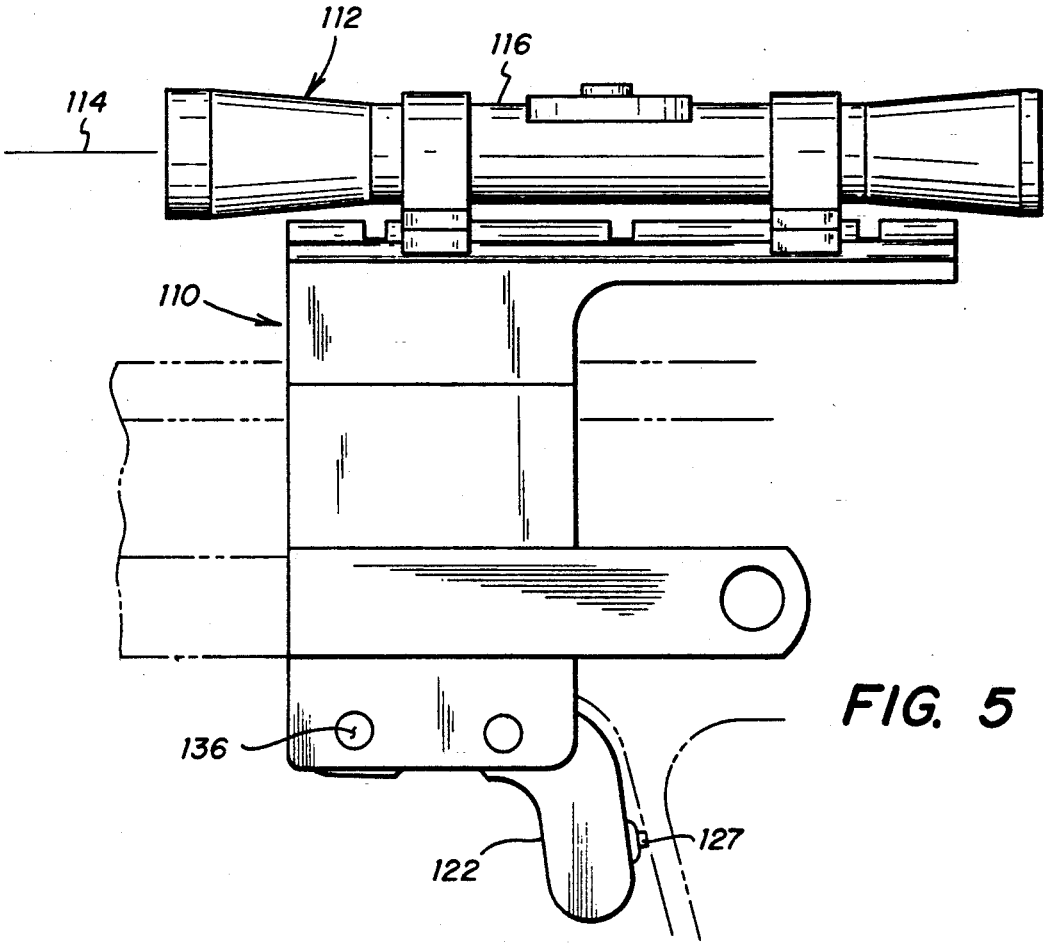
FIG. 5 is a side elevational view of another embodiment of the invention in which a mounting apparatus is employed to position an auxiliary sighting aid (such as a telescope or the like) above the barrel of a pistol.

Referring next to FIG. 5, another embodiment of the invention is shown in the form of an apparatus 110, which is adapted to be affixed to a pistol in a similar manner—but which is designed to position an auxiliary sighting aid above the pistol's barrel. Shown in this embodiment is a telescope 112 that is secured to the pistol so that its longitudinal axis 114 is at least generally parallel to the pistol's bore. As is customary with such scopes, it is characterized by having a generally cylindrical housing 116, such that it may be grasped and securely held by rings having a generally cylindrical internal configuration.

Figure 6:
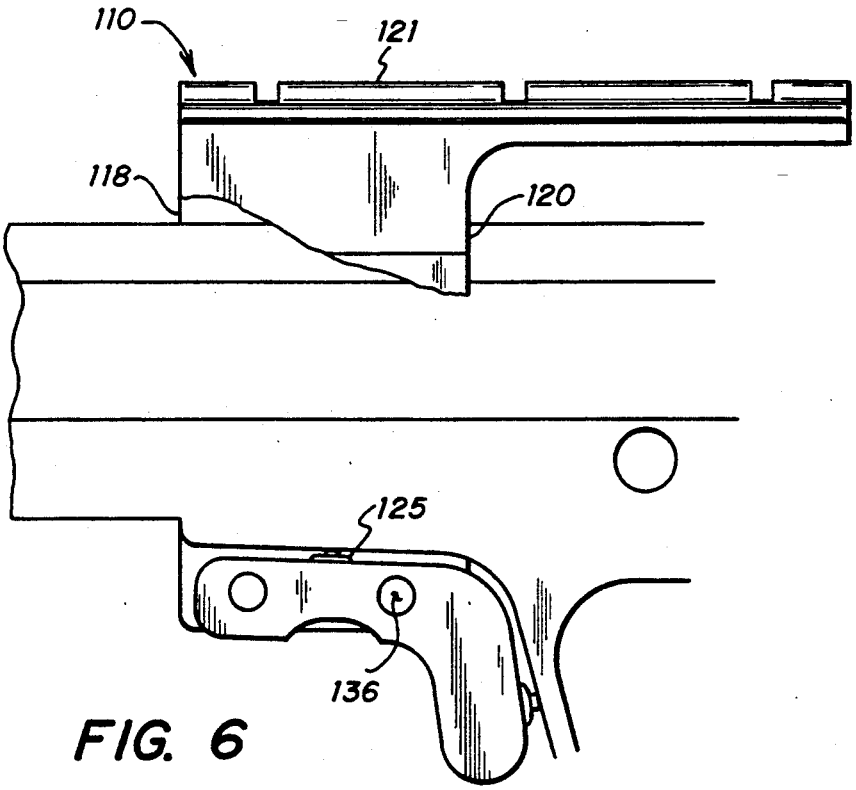
FIG. 6 is an elevational view similar to FIG. 5 but with the bulk of the left side plate being broken away in order to reveal certain internal spatial relationships.
Figure 7:
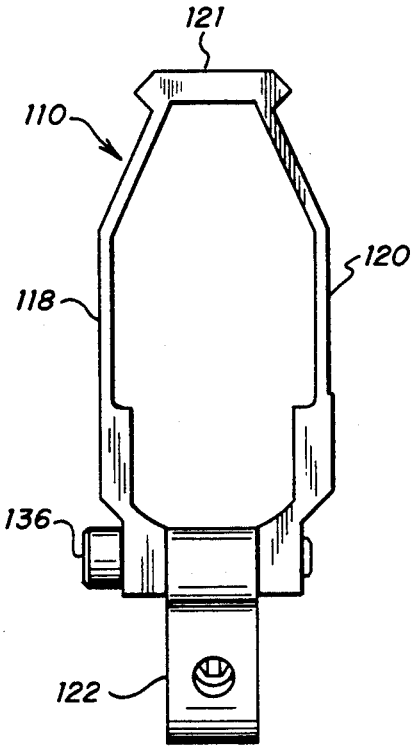
FIG. 7 is a front elevational view of the embodiment shown in FIG. 5.

Referring next to FIG. 6, a right side plate 118 is visible on the right side of the pistol because the left side plate 120 has been broken away to facilitate viewing the interior of the mounting apparatus 110. Referring additionally to FIG. 7, a lower portion of side plate 118 extends below the barrel where it may be connected with a suitably shaped bracket 122 using a mechanical fastening means to create a rigid unit. In this particular embodiment, the left side plate 120 is permanently connected to the right side plate 118 through a horizontal member 121 at the top of the apparatus 110. Thus, the combination of the right side plate 118, the connecting member 121, and the left side plate 120 form a generally U-shaped structure that constitutes the bulk of the apparatus 110. It will be apparent that the U-shaped structure is mounted upside down with respect to the pistol, such that the closed part of the U is high and the open part of the U faces downward. Bolts or cap screws 136 at the bottom of the U-shaped structure are effective to bridge the gap between the lower portions of the side plates 118, 120. A bracket 122 that is captured by bolts 136 creates a closed structure whose transverse cross-sectional appearance is that of a tall O. Indeed, it is preferable that the O-shaped apparatus 110 be sufficiently elongated so that there will be a significant space between the factory-original "iron" sights on a pistol and the bottom of the cross member 121. With such an arrangement, a person wishing to shoot the pistol at a target will have the option of using the original sights (by looking under cross-piece 121) or using a scope or the like that is attached to the top of cross-piece 121.

The preferred cross-sectional shape for a cross-piece 121 is similar to the base that is shown in U.S. Pat. No. 2,632,251 dated Mar. 24, 1953 to W. R. Weaver, or U.S. Pat. No. 4,328,624 dated May 11, 1982 to C. J. Ross. Such a base has V-shaped lateral sides that project outwardly from a generally horizontal bar whose width is relatively modest. Bases with this particular configuration have now become widely used and are frequently referred to as "Weaver-type" bases. Commercially available rings are readily attachable to such a base, with the result that the mounting of rings and a scope on Weaver-type bases can be accomplished by persons with minimal mechanical skills. In fact, each mounting apparatus disclosed herein may be aptly described as being of the no-gunsmithing type, because there is only minimal manipulation required in order to anchor each mounting apparatus to the frame of a pistol. Expressed in other words, the skills and talents of a traditional gunsmith are usually not needed in order to install a mounting apparatus of the type disclosed herein; and whatever alignment may be needed can usually be accomplished rather easily.

Those who are familiar with the teachings of Strahan will recognize that the cross-sectional shape of the mount 110 as seen in FIG. 7 bears a strong resemblance to the transverse cross-sectional shape of the mount shown in U.S. Pat. No. 4,418,487. While this is true, the mount 110 disclosed herein can be achieved by using a couple of extrusions, and much less machining is required than when a unitary (Strahan) mount is cut from a solid piece of metal. With the present design, which may be aptly described as a modular design, separate and relatively thin pieces (or modules) are provided—and they are joined together to create the shape that is needed to support an auxiliary sighting aid. Any one of the pieces or modules may often be independently changed without affecting the other pieces, so adaptation of this new design to another pistol might be made with relatively little effort.

Figure 9:
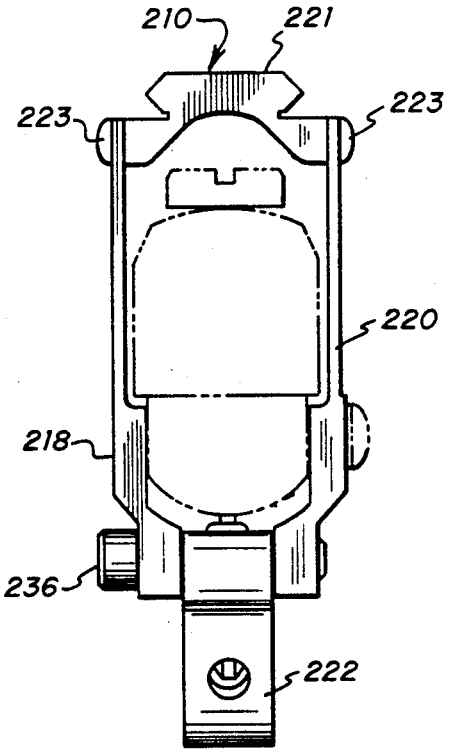
FIG. 9 is a front elevational view of the mounting apparatus shown in FIG. 8, clearly showing that the original factory sights are still present and may be used by a shooter, even when an auxiliary sighting device is affixed to the pistol above the barrel.
Figure 8:
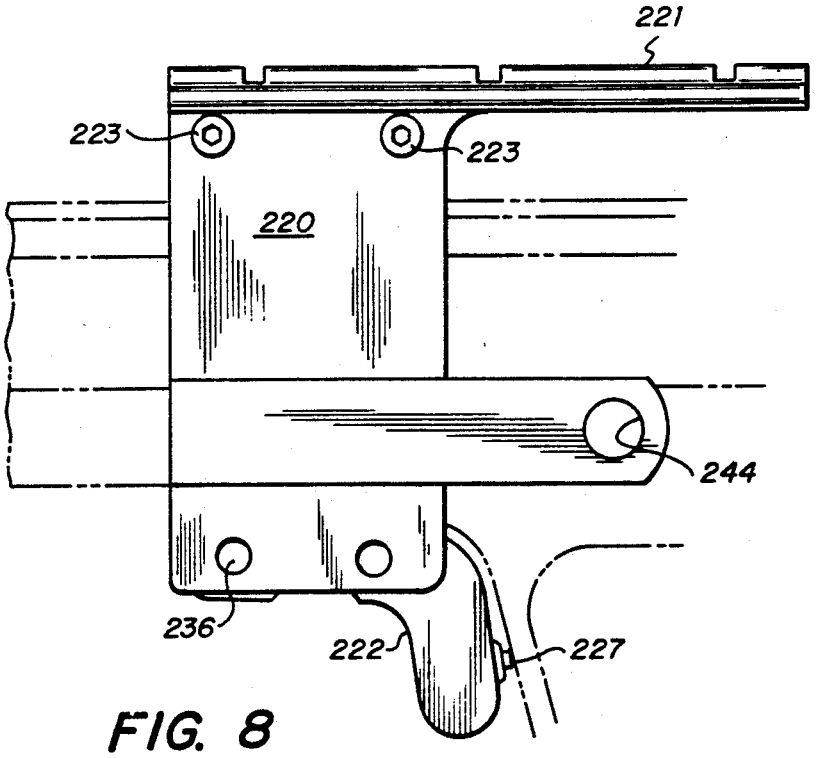
FIG. 8 is a side elevational view of still another embodiment of the invention, wherein four extruded pieces are interconnected with mechanical fasteners to define a closed space around the barrel of a pistol, and wherein an auxiliary sighting aid may be mounted above the pistol's barrel.

Turning next to FIGS. 8 and 9, an alternate embodiment for an over-the-barrel mount is shown in which four major pieces are put together in order to create a mount 210 having the elongated O shape that was shown in FIG. 7. A right side plate 218 and a left side plate 220 are clearly visible in this figure, and they are deliberately formed as mirror images of each other—such that they may be readily machined from the same long piece of extruded metal. A rigid bracket 222 is sized to close the bottom of the O, and a top piece 221 extends between and connects the tops of the side plates 218, 220. The top piece 221 also has a Weaver-type configuration integrally molded into it; so connecting this piece to the tops of the side plates 218, 220 with a plurality of screws 223 will produce a sturdy base to which can be attached a variety of auxiliary sighting aids. This modular design permits very close side-to-side fitting of the side plates 218, 220 to the frame of the pistol, without introducing any stress in a U-shaped extrusion, because the width of a bracket 222 and any cross piece 221 can be adjusted with minor grinding (to take away any excess material) or with shims (to fill in any gap) to create a fit against the sides of the frame that meets any desired degree of snugness.

To design a specific mount in accordance with this invention, it will usually be necessary that a sample be obtained of the pistol on which the mount is to be fitted. Alternatively, a set of detailed drawings showing the exterior of the pistol may be referred to, in order to obtain the necessary dimensions that will be used to establish whether an existing mount can be modified or whether any new components must be fabricated. In some cases, the only new element that might be needed could be a new L-shaped bracket to fit into the space in front of the trigger guard. A bracket of given thickness can be easily achieved by extruding an aluminum shape having the desired cross-section and then cutting pieces off the end of the shape, the direction of the cuts naturally being transverse to the longitudinal axis of the extruded shape. The thickness or width of a bracket 22 like that employed with mount 10 will usually be such that the bolts 36 will tighten up on the side plates 18, 20 at just about the same time that the side plates make contact with the sides of the pistol's frame. However, if it should turn out that there is a very small side-to-side clearance between the interior surfaces of the side plates 18, 20 and the pistol's exterior, this will not be a problem, because the side plates are not really designed to provide a clamping action on the pistol for load-carrying purposes. All of the reaction loads due to firing the pistol are expected to be carried by the adjustment screws 25, 27, which lie in the longitudinal plane of the frame. Also, having a less than rigid "grip" between the side plates and the frame will permit at least some small adjustment in the mount's orientation (using screws 25, 27), if necessary. On the other hand, having too much clearance between the side plates and the frame would not be desirable, because any significant space might serve as a trap for dust, moisture, etc.

With the constructions described herein, there is no intimate contact between the "interior" surfaces of the bracket and the exterior surfaces of the pistol near the trigger guard. Instead, the bracket's "interior" surfaces have only a general shape that resembles that of the pistol's exterior. Longitudinal contact between the mount and the pistol takes place only between the brass tips of the two adjustment screws 25, 27 and the exterior of the pistol. Furthermore, this contact by the tips of the adjustment screws covers an area that is relatively small, and wide side-to-side (or transverse) contact between a mount and a pistol over a broad area is neither necessary nor desirable. In fact, to create a new mounting apparatus for a different pistol may require only the substitution of adjustment screws of a different length, or perhaps the fabrication of a bracket of a slightly different thickness or a different angle. Because a bracket may be simply sliced from an extruded bar at essentially any desired thickness, it could take very little design or engineering work to create a new mounting apparatus, once the general outline of a new pistol is known. Of course, if a mount already exists for one pistol, and then a radically different pistol is to be fitted with a similar mount, a revised side plate might be desirable for the new pistol—in order to optimize the spacing that is achieved as a mechanical fastening means is secured to the two plates with a pistol positioned therebetween. In any event, the absence of meticulous matching between a mount and a pistol's contour certainly makes this concept attractive from a manufacturing point of view.

Perhaps it should be mentioned that there are several terms that have been used in this description that must be understood to be relative terms. That is, terms such as "up", "down", "forward", "above", "below," etc., should be recognized as having been used in describing relative spatial relationships rather than being absolute terms. And in describing a sighting aid as being "above" or "below" a barrel, etc., it has been assumed that the pistol is being held as a shooter might hold it when shooting down range, with the barrel being held generally horizontally, etc. A plane that passes longitudinally through the pistol's frame is assumed to be vertical. Changing the orientation with which a pistol is being held in a person's hand would obviously alter the relative position of one element with respect to another, in an absolute sense, but any such change should be understood to be inconsequential as far as the concepts being disclosed herein.

While only certain favored embodiments of the invention have been disclosed herein in great detail, those skilled in the art will no doubt recognize that variations in the principles described might be accomplished without departing from the overall theory of operation and/or concept of fabrication. For example, others may prefer an alternate way of securing a mounting apparatus against longitudinal movement when a pistol is fired. But it is believed that the slide stop pin in many semi-automatic pistols provides such a convenient location for anchoring a mounting apparatus as to make it the current favorite for ensuring that there will be adequate resistance against recoil when a pistol is fired. Too, any of the plates and brackets that have been described as being temporarily held together by mechanical fasteners or the like could be assembled in such a way as to render them permanently connected. So while it is believed that the modular concept of putting a mount together has been fully justified, this does not mean that a given mount must necessarily be susceptible of being taken apart in the reverse manner that it was put together. Furthermore, it should be readily apparent to those skilled in the art that the size and shape of the cavity into which the auxiliary sighting aid is to be fitted may be readily enlarged, reduced or altered—without departing from the spirit of the claims attached hereto.

What is claimed is:

1. An apparatus having utility in mounting an auxiliary sighting aid on a pistol, said sighting aid having an elongated body with a longitudinal axis, and the pistol having a frame and a barrel and a longitudinal bore in the barrel, and the barrel also having a right side and a left side, and the pistol having a trigger guard that is rigidly fixed to the pistol's frame so as to form a structural extension thereof, and the apparatus being constructed in such a way that the longitudinal axis of the elongated body will be generally parallel to the bore when the elongated body is held by the apparatus, comprising:

a. a right side plate that is configured so that it may be attached to the pistol adjacent a portion of the right side of the pistol's barrel;

b. a left side plate that is configured so that it may be attached to the pistol adjacent a portion of the left side of the pistol's barrel, and the right and left plates also being configured to cooperate in supporting an elongated body in such a way that the longitudinal axis of the body will be generally parallel to the bore;

c. a bracket having a width that is sized to fit between the right and left side plates and below the barrel, and the bracket having two angularly arranged portions that lie in planes which intersect one another with an angle of at least 45 degrees;

d. fastening means for holding together the right and left side plates and the bracket in such a way as to form a substantially rigid combination; and e. means for firmly anchoring the side plates to the pistol in order to preclude longitudinal movement of the side plates when the pistol is fired and recoil loads are experienced, and the bracket being ahead of the trigger guard when the side plates are anchored to the pistol.

2. The apparatus as claimed in claim 1 and further including adjustment means for eliminating any slack that may exist between the bracket and the pistol's frame when a combination consisting of the right and left side plates and the bracket is attached to the pistol.

3. The apparatus as claimed in claim 2 wherein the adjustment means for eliminating slack comprises an adjustment screw in each of the two angularly arranged bracket portions, and each of the bracket portions having threaded bores in which the adjustment screws are selectively advanced and retracted, and the threaded bores lie in a common plane and are inclined with respect to one another by an angle of about 80 degrees.

4. The apparatus as claimed in claim 1 wherein the elongated body encompasses an auxiliary sighting aid that is selected from the group consisting of pistol scopes, night-vision devices, lasers and flashlights.

5. The apparatus as claimed in claim 1 wherein a plane passing transversely through the pistol's barrel and the right and left side plates will will define transverse cross-sectional shapes in the right and left side plates, and the transverse cross-sectional shapes of the right and left side plates are identical.

6. The apparatus as claimed in claim 1 wherein the right and left side plates are formed from extruded aluminum.

7. The apparatus as claimed in claim 1 wherein the bracket has two structural portions that intersect one another with an angle of about 80 degrees.

8. The apparatus as claimed in claim 1 wherein the elongated body is generally cylindrical, and wherein the diameter of said body is within the range of about ¾ inch to about one inch.

9. The apparatus as claimed in claim 1 wherein the side plates extend below the barrel for a significant distance and the elongated body is mounted below the barrel.

10. The apparatus as claimed in claim 1 wherein the side plates extend above the barrel for a significant distance and the elongated body is mounted above the barrel.

11. The apparatus as claimed in claim 1 wherein the fastening means constitutes a pair of transverse bolts that extend from either one of the right and left side plates through the bracket to the other one of the two side plates, said bolts having external threads, and said other one of the two side plates having internally threaded means for engaging external threads on the pair of transverse bolts.

12. The apparatus as claimed in claim 1 wherein the right and left side plates each include fragmentary sections of a cylinder of given diameter, whereby spacing the side plates apart in a confronting relationship will define a generally cylindrical space therebetween, and whereby an actual cylinder having a diameter approximately equal to said given diameter will fit snugly between the confronting side plates when the fastening means is secured.

13. The apparatus as claimed in claim 1 wherein the bracket is made of extruded aluminum.

14. The apparatus as claimed in claim 1 wherein the right and left side plates are connected by a rigid member at a location above the barrel and remote from the bracket, and wherein the transverse cross-sectional shape of said rigid member is that of a Weaver-type base, whereby a ring clamp may be selectively attached to said rigid member for mounting an auxiliary sighting aid on top of said apparatus.

15. The apparatus as claimed in claim 14 wherein the right and left side plates are permanently connected at their tops by said rigid member but are only temporarily connected at their bottoms by the fastening means, whereby the side plates may be separated as a unit from the bracket and removed from a pistol at any desired time.

16. The apparatus as claimed in claim 14 wherein the right and left plates are joined at their tops by selectively removable mechanical fasteners, whereby the mount may be removed from a pistol at a desired time and disassembled to produce a plurality of discrete parts.

17. A mount for use in attaching an auxiliary sighting aid to a pistol, the pistol having a frame and a barrel with a bore therein, and the auxiliary sighting aid being selected from the class consisting of lasers, flashlights, telescopes and night-vision devices, comprising:

a. first and second relatively thin side plates configured to rest on either side of the pistol's barrel, and each of the side plates having a first portion that is configured to bear against a portion of the barrel, and each side plate having a second portion that is configured to bear against a side of a housing for an auxiliary sighting aid;

b. a structural bracket adapted to serve as a rigid spacer for insertion between the first and second side plates to form a three-piece structural combination;

c. mechanical fastening means for fixedly connecting the three-piece structural combination into a rigid unit; and d. means for connecting the rigid unit to the pistol's frame in such a way that an auxiliary sighting aid may be aligned so as to be generally parallel with the pistol's bore.

18. The mount as claimed in claim 17 wherein the first and second side plates have transverse cross-sectional shapes that are identical, whereby both of said side plates may be extruded as an elongated body from a common die and both of said side plates may even be cut from the same elongated body.

19. The mount as claimed in claim 17 wherein the structural bracket constitutes a slice that is cut transversely from an extruded aluminum shape.

20. The mount as claimed in claim 17 wherein the structural bracket has a side elevational appearance that is generally equivalent to the letter L.

* * * * *